United States Patent [19]

Nishikawa et al.

[11] Patent Number: 4,556,045

[45] Date of Patent: Dec. 3, 1985

[54] REFLECTION TYPE KEROSENE STOVE

[75] Inventors: Hideo Nishikawa; Kenzo Okamoto, both of Osaka; Koichi Sakai, Moriguchi; Fumihiko Kitada, Neyagawashi, all of Japan

[73] Assignee: Imanishi Kinzoku Kogyo Kabushi Kaisha, Osaka, Japan

[21] Appl. No.: 703,814

[22] Filed: Feb. 21, 1985

Related U.S. Application Data

[63] Continuation of Ser. No. 561,979, Dec. 16, 1983, abandoned.

[30] Foreign Application Priority Data

Jun. 22, 1983 [JP] Japan ..... 58-094997

[51] Int. Cl.[4] ..... F24C 5/04

[52] U.S. Cl. ..... 126/96; 431/321

[58] Field of Search ..... 126/96, 97, 93, 265, 126/267, 59.5, 208, 209; 431/13, 100, 320, 321, 322, 344

[56] References Cited

U.S. PATENT DOCUMENTS

| | | | |
|---|---|---|---|
| 514,555 | 2/1894 | Keils | 126/96 |
| 2,227,251 | 12/1940 | Engh | 126/96 X |
| 4,357,929 | 11/1982 | Johnson | 126/96 |

*Primary Examiner*—Randall L. Green

*Attorney, Agent, or Firm*—McCormick, Paulding & Huber

[57] ABSTRACT

A reflection type kerosene stove of which the kerosene meter and kerosene inlet are located in a space provided in the stove body and closed by a door, thus hiding the kerosene meter and inlet which are liable to be soiled with kerosene, when not used.

2 Claims, 2 Drawing Figures

REFLECTION TYPE KEROSENE STOVE

This is a continuation of co-pending application Ser. No. 561,979 filed on Dec. 16, 1983, now abandoned.

The invention relates to a novel structure of a reflection type kerosene stove (referred to as "kerosene stove" below).

In this type of kerosene stove, the kerosene meter, kerosene inlet and the like provided on the upper surface of the kerosene tank or their periphery is liable to be soiled with kerosene. The kerosene remaining on such parts is difficult to remove and not easily accessible. The remaining kerosene on the exposed surface of the stove looks dirty and is therefore not desirable since this type of stove forms part of the interior.

The object of the invention is to provide a kerosene stove of a novel structure wherein the kerosene meter and kerosene inlet are located inside the stove body so that they may not be exposed to sight when not used.

The invention will now be described with reference to the drawings showing an embodiment.

Figure 1:
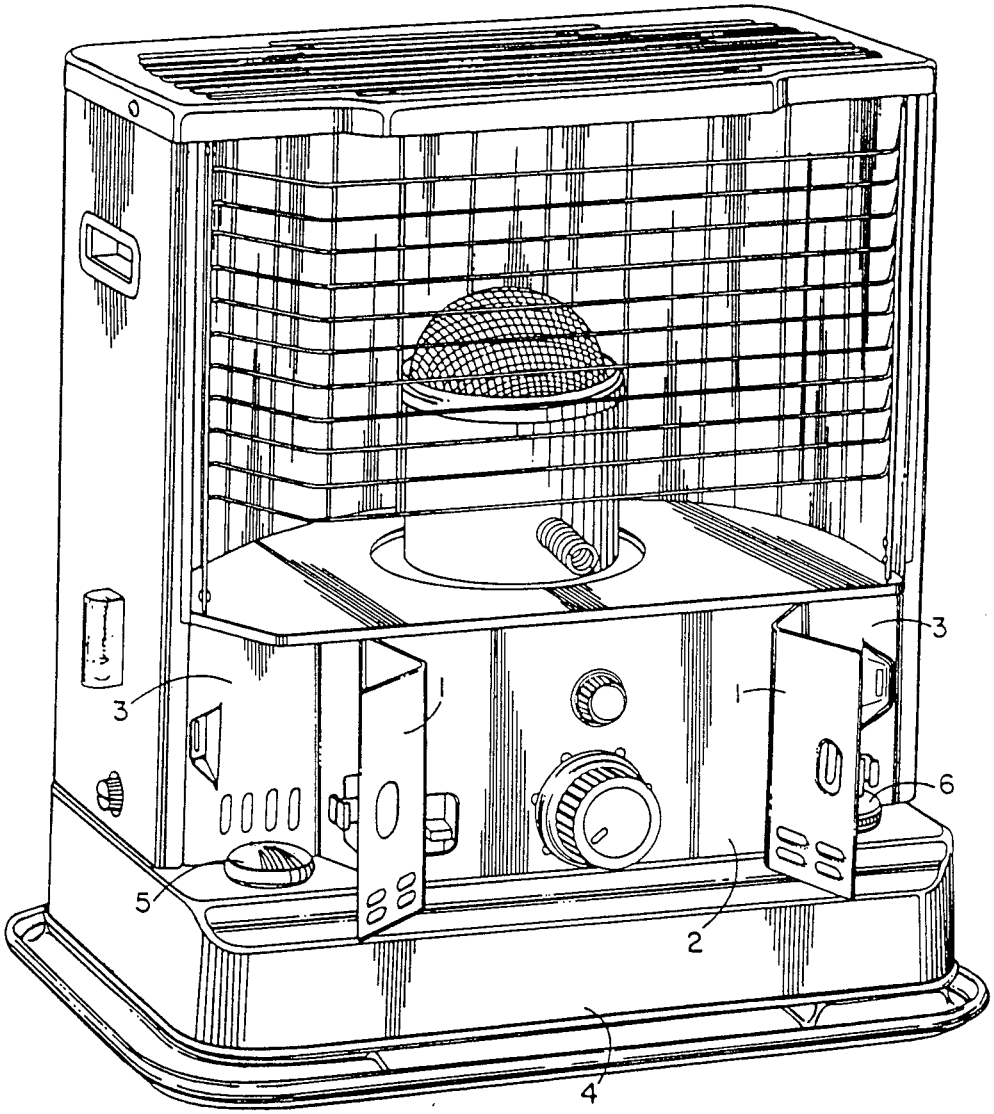
FIG. 1 is a front left top quartering perspective view illustrating a reflection type kerosene stove equipped with hinged corner doors or covers constructed in accordance with the present invention. The doors are shown in their open condition in this view.

A front board 2 is provided on its opposite sides with doors 1, 1 to close spaces 3, 3. A kerosene meter 5 is provided in any one of the spaces 3, 3 on the upper surface of a kerosene tank 4 while a kerosene inlet 6 is provided in the other space 3. While in the embodiment shown, the doors and spaces are provided symmetrically on the right and left sides, a larger door and a space may be provided on either side so as to accommodate both the meter and inlet. The doors may be provided with a lock where necessary.

Figure 2:
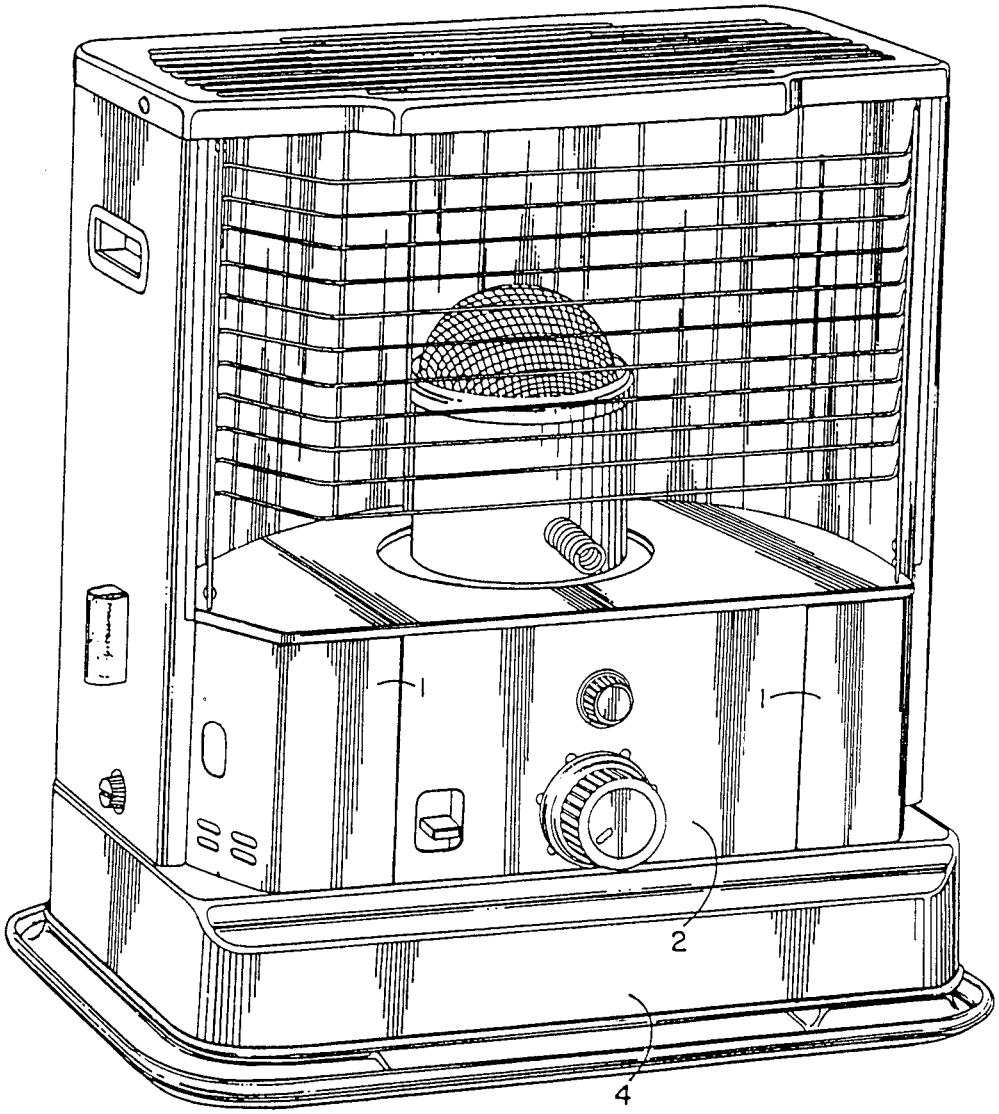
FIG. 2 is a view similar to FIG. 1 but illustrating the corner doors in their closed condition.

Owing to the structure described above, when the kerosene meter or the kerosene inlet is not used, the doors 1, 1 may be closed as shown in FIG. 2, to hide the kerosene meter and inlet and their periphery. Thus the appearance of the stove is not spoiled. Further the structure may prevent infants from playing with the kerosene meter and inlet.

We claim:

1. In a reflection type kerosene stove having a tank to store kerosene fuel together with a burner mantle assembly and control means for regulating fuel flow, the improvement to such a stove comprising a base forming the fuel tank, said base having a generally rectangular shape with end, back, rear and top walls and a front wall, a vertically extending front panel above said tank base and oriented parallel to said front wall of said tank base, a stove superstructure above said base and having end and back walls and coextensive with said base end and back walls and cooperating with said front panel and with said front and top walls to define recessed spaces adjacent the corners of said stove superstructure beside said front panel, fuel inlet means in one such recessed space for filling said fuel tank, fuel meter means in the other such recessed space to indicate the fuel quantity in such tank, covers for said recessed spaces adjacent the corners of said stove superstructure, each of said covers having an L-shaped configuration with angularly related cover panel parts, one of each such cover parts oriented in the plane of said front panel when the cover is closed, hinges connecting said covers to said front panel for selectively enclosing said corner defined spaces.

2. The stove according to claim 1 wherein said stove superstructure also defines a compartment above said front panel for said mantle assembly, said compartment having a shelf-like floor, which floor also defines the upper boundary of said recessed corner spaces.

* * * * *